United States Patent [19]

Satake

[11] 4,155,295

[45] May 22, 1979

[54] RICE PEARLING APPARATUS

[76] Inventor: Toshihiko Satake, 2-38, Saijonishihonmachi, Higashihiroshima, Japan

[21] Appl. No.: 908,805

[22] Filed: May 24, 1978

Related U.S. Application Data

[62] Division of Ser. No. 736,565, Oct. 28, 1976, abandoned.

[30] Foreign Application Priority Data

Oct. 29, 1975 [JP] Japan ..... 50-130807

[51] Int. Cl.[2] ..... B02B 1/04; B02B 3/12

[52] U.S. Cl. ..... 99/516; 99/518; 99/524; 99/567; 426/482

[58] Field of Search ..... 99/568, 486–488, 99/516, 518, 520–522, 524, 567, 608, 609, 493, 600; 426/482, 483, 507, 511, 461; 222/25, 57, 134

[56] References Cited

U.S. PATENT DOCUMENTS

| | | | |
|---|---|---|---|
| 881,135 | 3/1908 | Kirk | 222/57 X |
| 1,121,846 | 12/1914 | Kirk | 222/57 X |
| 1,136,596 | 4/1915 | Friend et al. | 99/487 |
| 1,962,642 | 6/1934 | Haines | 99/493 X |
| 2,355,810 | 8/1944 | Loewy | 426/483 |
| 3,401,731 | 9/1968 | Wayne | 99/518 |

FOREIGN PATENT DOCUMENTS

| | | | |
|---|---|---|---|
| 26822 | 8/1971 | Japan | 426/482 |

OTHER PUBLICATIONS

Rice Milling, Autrey and Grigorieff, Agricultural and Food Chemistry, vol. 3, No. 7, pp. 593–599, Jul. 1955.

*Primary Examiner*—Stanley N. Gilreath
*Attorney, Agent, or Firm*—Jay L. Chaskin

[57] ABSTRACT

A rice pearling apparatus of the type including a pearling chamber formed by a pearling roll and a multiple-holed debranning-pearling cylinder surrounding the roll, and a device for feeding rice to the pealing cylinder, further comprises a device for supplying water to the pearling chamber, flow meters for measuring and indicating the rates of rice and water flow into the chamber, and a device for regulating the respective flow rates of rice and water.

1 Claim, 5 Drawing Figures

RICE PEARLING APPARATUS

This is a division of application Ser. No. 736,565, filed Oct. 28, 1976, now abandoned.

This invention relates to improvements in a rice pearling apparatus, designed to control by suitable means the proportions of flow rates of rice and water to be added for the scouring purpose in the last stage of pearling.

It is well-known that when brown rice has been milled to a yield of about 91% the grain surface hardens and the progress of pearling slows down or even comes to an end, making it especially difficult to remove the aleurone layer from the thin longitudinal furrows of the grain.

In fact, complete removal of the aleurone layer is next to impossible. In the superfine pearling of rice for brewing (to a yield of 80–46% on the basis of the brown rice weight), for example, an intermediate degree of pearling down to a yield of over 70% will not be enough to separate the aleurone layer completely from the thin longitudinal furrows behind the germ of the grain. The layer is so fast in the furrows that it cannot be removed unless the rice is pearled by abrasive action to a yield of about 70–65%. The rice for ordinary family consumption is not pearled beyond the practical limitation where the yield is 88%, and naturally retains remnants of the aleurone lyaer. Thus, conventional pearling machines have been unable to produce bright, finely pearled rice for home consumption.

The present invention is directed to the provision of an improved rice pearling apparatus capable of pearling rice to a high degree (yield of 91–88% on the basis of the brown rice weight), removing the aleurone layer from the thin longitudinal furrows of the grain at such a relatively high rate of yield, and thereby giving bright, finely pearled rice for home consumption.

This invention is based on the discovery that finish scouring of rice with water, when combined with instantaneous bran separation, will completely and easily remove the aleurone layer from the individual grains of rice despite a low degree of pearling accomplished. If water and rice are in contact for an extended period of time, the water will permeate deep into the individual grains, causing the latter to crack and break upon exposure to air after the conclusion of pearling. To avoid this, it is essential that the contact time be very short. In addition, the proportions of the amounts of water and rice have an important and delicate bearing on the pearling result. Therefore, once a proper ratio of flow rates has been set, it is desirable that in response to any change in the flow rate of rice the flow rate of water be proportionally adjusted in automatic operation.

In brief, in the process of pearling with finish scouring, the effect of preventing cracking of the rice grains depends upon two factors; the length of time for which the rice grains contact water and the water content of the pearled rice (weight of water as divided by the weight of rice). Strictly speaking, the load of pearling action would be another factor but actually it is not as significant as either of the said two. In other words, a minor variation of the load ratio would not have as material an influence as a minor change in the ratio between the flow rates of rice and water might have on the cracking property of the rice grains. After diversified experiments it has now been found that, when the pearling operation has progressed to a stage such that the process would slow down in conventional dry friction polishing, water may be added, for example, in an amount of about 0.5 to 1.5% to rice milled to a yield of 93% or less on the basis of the brown rice weight, or in an amount of about 0.1 to 0.3% in the case of salt water with a salt concentration of about 3 to 26.4% at ordinary temperature (20° C.), so as to soften the thin surface layer of the rice grains and permit the removal of the aleurone layer. It has also beeen found that, because milled rice absorbs water, the shorter the period of time for which the rice contacts and gets wet with water the higher the safety factor against cracking of the grains will be under the conditions of sufficient softening for the removal of the aleurone layer. For the same reason, it is ideal, of course, that the amount of water should be minimized under the conditions that make the grain surface soft enough to release the aleurone layer.

As will be appreciated from the foregoing, the proportions between the flow rates of water and rice is extremely delicate and, once the flow rate of rice has been set to a desired value, the water flow rate too should be automatically set to a proportional value.

The object of the invention is realized by providing a rice pearling apparatus including a pearling chamber composed of a pearling roll and a multiple-holed debranning-pearling cylinder surrounding the roll, and means for feeding rice to the pearling chamber, characterized in that the apparatus further comprises means for supplying water to the pearling chamber, flow meters for measuring and indicating the rates of rice and water flow into the pearling chamber, and means for regulating the respective flow rates.

Also, according to the invention, a rice pearling apparatus is provided which includes a pearling chamber composed of a pearling roll and a multiple-holed debranning-pearling cylinder surrounding the roll, and means for feeding rice to the pearling chamber, characterized in that the apparatus further comprises means for supplying water to the pearling chamber, and means for coordinately and automatically adjusting the rates of rice and water flow into the pearling chamber in a suitably predetermined ratio.

Figure 1:
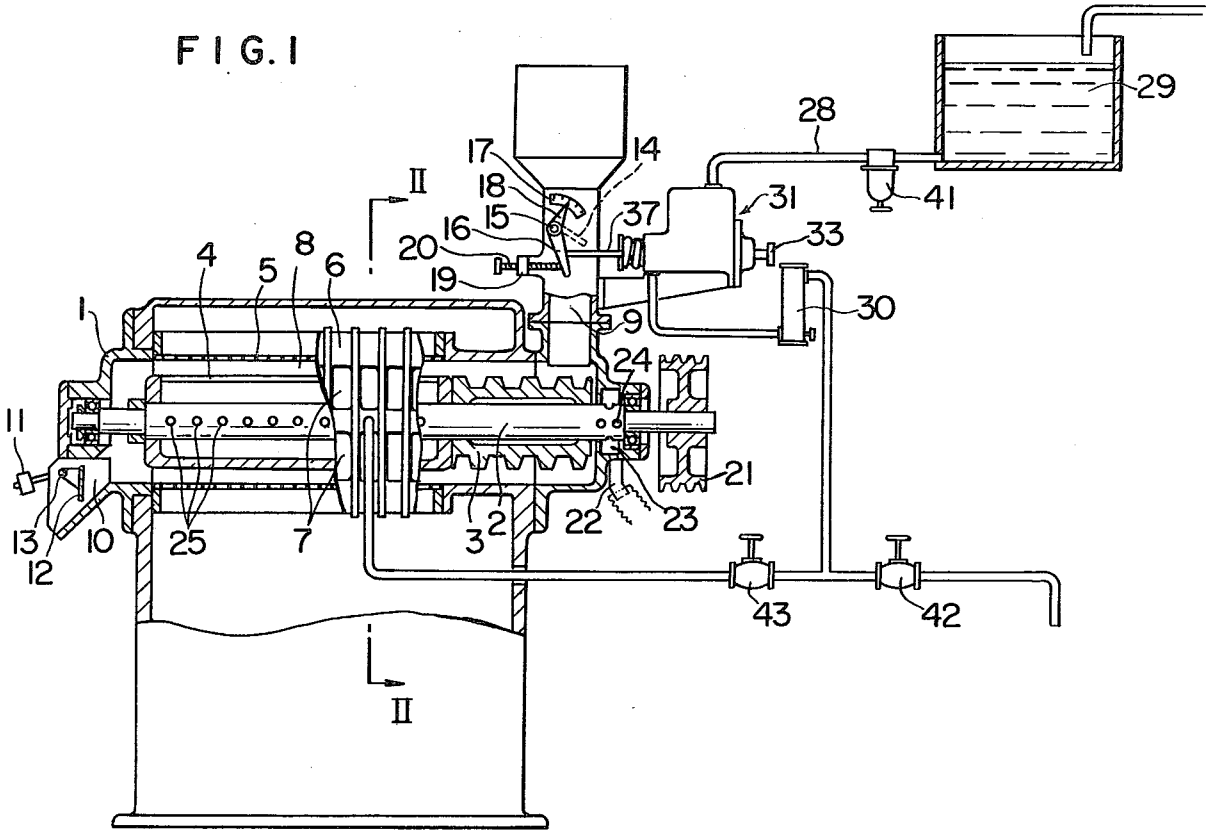
FIG. 1 is a partly sectional side view of an embodiment of the invention.
Figure 2:
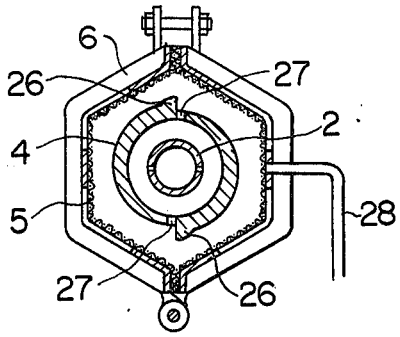
FIG. 2 is a sectional view taken along the line II—II of FIG. 1.
Figure 3:
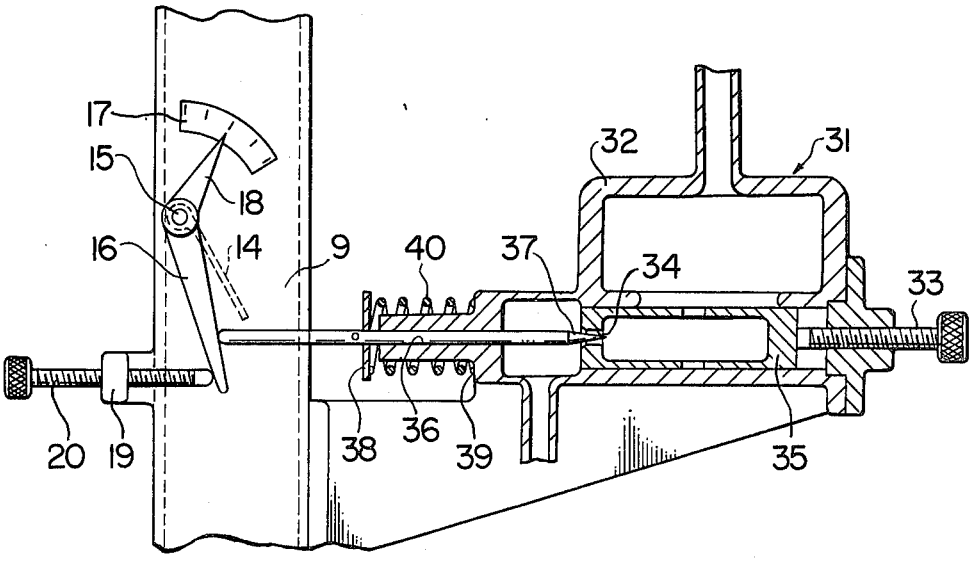
FIG. 3 is an enlarged, partly sectional side view of the essential parts of FIG. 1.

Referring to FIGS. 1 to 3, there is shown a rice pearling apparatus including a housing 1, a main shaft 2 rotatably journaled in the housing, and a screw conveyor 3 and a pearling roll 4 both of which are fixedly mounted on the shaft for revolution therewith. Inside the housing a multiple-holed, debranning-pearling cylinder 5, for example, of wire screening, which is polygonal in cross section, surrounds the pearling roll 4. The cylinder 5 is fixed to the housing by an inner frame 6 which, too, is polygonally shaped and is of a latticed construction with a number of open spaces 7. The inner frame 6 covers and holds the debranning-pearling cylinder in place. These components are assembled together to form a pearling chamber 8. The housing 1 has a rice inlet 9 open to the end of the screw conveyor 3 opposite to the end contiguous to the pearling roll. On the other end of the housing 1 which is axially opposite to the end where there is the inlet, an outlet 10 is formed in communication with the pearling chamber 8. In this outlet a pressure plate 12 under the load of a weight 11 is swingably supported by a pivot 13. In the rice inlet 9 a valve 14 for regulating the flow rate of rice to be polished is mounted on a pivot 15 supported by the surrounding wall so that the valve can turn together with the pivot. A lever 16 is secured at one end to the end of the pivot 15 extending outwardly through the inlet wall. Also, an indicator 18, adapted to cooperate with a dial 17 affixed to the outer surface of the rice inlet to indicate the flow rate of rice, is secured at the base end to the same pivot, turnably therewith. On the outer surface of the rice inlet is formed a support lug 19 with an internally threaded hole. A threaded rod 20 engages the threaded hole and extends to bear against the portion of the lever 16 near its free end, so that the turning of the threaded rod 20 is transmitted through the lever 16 and pivot 15 to alter the opening of the regulating valve 14 and thereby adjust the flow rate of rice. As shown in FIG. 1, a drive pulley 21 is attached to the free end of the main shaft 2. The shaft 2 is hollow except bearing portions, and an air inlet 22 formed in the housing 1 is communicated with an annular air chamber 23 surrounding the shaft. The shaft portion thus surrounded has air intake holes 24, while the shaft portion enclosed in the pearling roll 4 is formed with air discharge holes 25. As can be seen from FIG. 2, the pearling roll 4 has two axial ribs 26, each accompanied parallelly with an axial slit 27.

To supply the pearling chamber with water for the mixing and scouring use, a water supply line 28 is communicated at one end with the pearling chamber and at the other end with a water supply tank 29 through the debranning-pearling cylinder 5. Midway between the both ends a flow meter 30 and a flow controller 31 are installed. As shown in FIG. 3, the body 32 of the flow controller 31 accommodates a cylindrical valve-seat-adjusting member 35 one end of which is connected to a threaded rod 33, the other end of the member being formed with a through hole 34 that forms a valve seat. The valve-seat-adjusting member 35 is made movable axially by the rotation of the threaded rod. The body 32 has a bore 36 opposed and aligned to the through hole 34, and a needle valve 37 is slidably fitted in the bore. The needle valve includes a flange 38, and a coil spring 40 is carried between the flange and a shoulder 39 of the body 32 so that the outer end of the needle valve 37 always bears against the lever 16. In FIG. 1 the numeral 41 indicates a strainer, and 42, 43 indicate valves. The threaded rod 33 is turnable to change the annular gap between the tapering end of the needle valve 37 and the through hole 34 that forms a valve seat, thereby controlling the water supply. Proper interrelated adjustments of the threaded rods 20, 33 can be made with reference to the readings of the dial 17 and flow meter 30 and, in this way, water can be mixed with the rice being treated to an appropriate water content as already stated. It will be seen from FIGS. 1 and 3 that the rice flow-regulating valve 14 for feeding rice to the pearling chamber 8 through the inlet 9 is operatively connected by the lever 16 to the needle valve 37 of the flow controller 31 for supplying water for the mixing and scouring use to the pearling chamber 8 through the water supply line 28. Thus, once the flow rates of rice and water are adjusted to a suitable ratio that satisfies the pearling conditions as specified above, adequate mixing will always be accomplished because, whenever the rice flow rate is changed and adjusted by the turning of the threaded rod 20, the water supply will be proportionally adjusted to an optimum rate under automatic control.

The operation of the pearling apparatus shown in FIGS. 1 through 3 will now be described. The embodiment is illustrated as the last finishing one of several pearling units arranged in series. As rice preliminarily milled to a yield of 94–93% is fed to the inlet 9, the running screw conveyor 3 carries the rice to the pearling chamber 8, where the rice grains are violently moved for mutual friction by the ribs 26 of the revolving roll, and pearling is carried out. During this operation, water is introduced into the pearling chamber from the water supply line 28 in the position shown to ensure the suitable mixing and scouring of rice with water as described above. The water softens the thin surface layer of the rice grain and facilitates the removal of the hardly separable aleurone layer that remains fast in the thin longitudinal furrows of the grain. The friction between the rice grains develops sufficient heat to evaporate off the water, supplied in a suitable amount, immediately after the softening of the thin surface layers of the individual grains; there is no time left for the water to permeate into the endosperm. Since the contact between the water and rice grains is limited within a very short period of time, cracking of the grains upon complete pearling is prevented. Although not shown, the air inlet 22 of the housing 1 of the pearling apparatus is communicated with a compressed air source or a suction blower mounted in the lower space of the housing or is communicated with the both when installed. The air thus supplied flows through the air intake holes 24 into the hollow main shaft and leaves the same through the discharge holes 25 into the pearling roll. The air then blows out of the slits 27 of the roll, and the resulting streams carry the bran formed by pearling and pass together through the debranning-pearling cylinder for removal of the bran through the open spaces 7 of the inner frame 6. In this manner bran separation is instantaneously accomplished without clogging the wire screen. The scouring with water combines with the instantaneous debranning by air streams to remove the aleurone layer completely from the thin longitudinal furrows of the grain, thus affording bright, finely polished rice for general home consumption.

Figure 4:
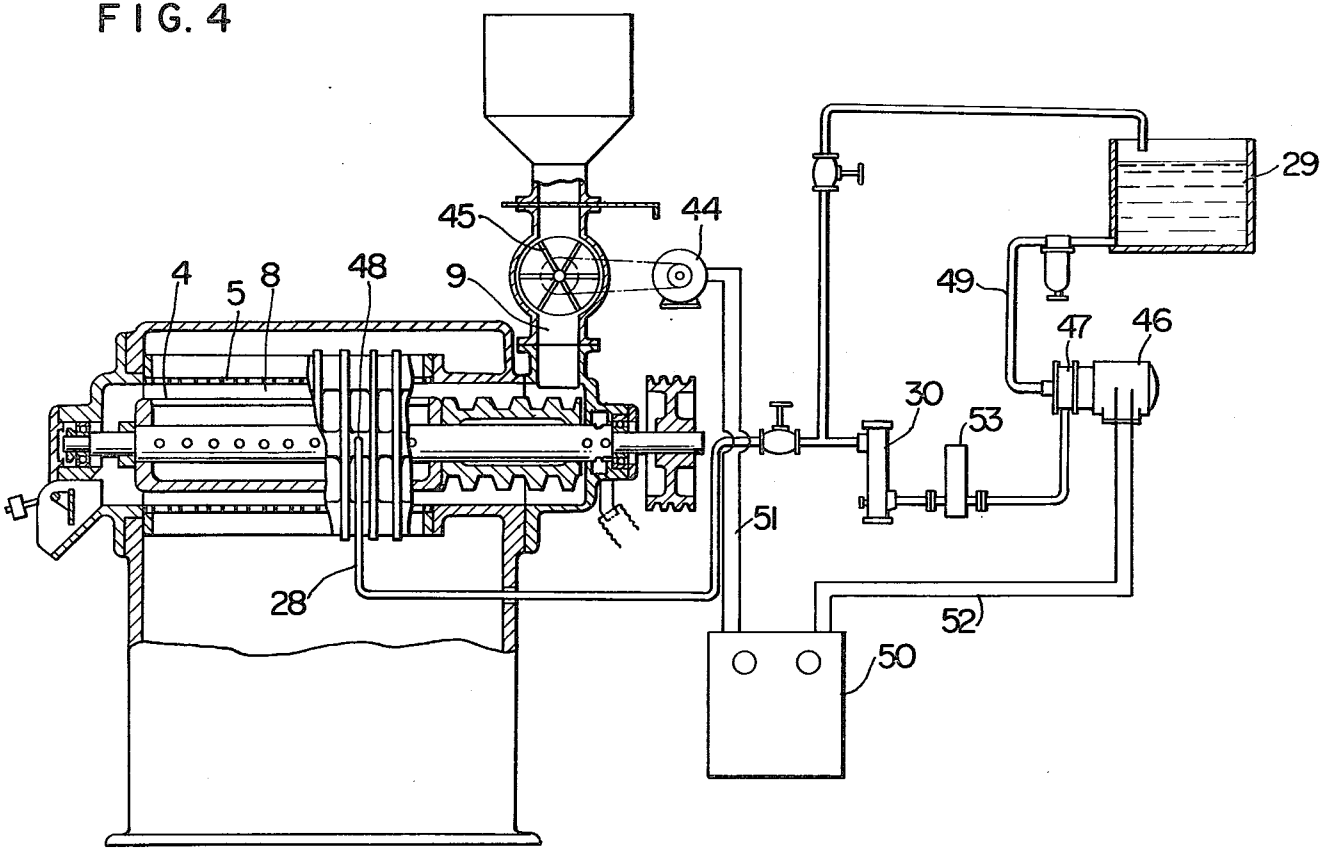
FIG. 4 is a partly sectional side view of another embodiment of the invention.

In another embodiment shown in FIG. 4, a rotary valve 45 to be driven by a motor 44 is supported with a shaft in the rice inlet 9 for feeding rice to the pearling chamber 8 formed between the multiple-holed debranning-pearling cylinder 5 and the pearling roll 4 accommodated in the cylinder. Also, a water supply pump 47 to be driven by a motor 46 is installed in the water supply line 28 leading to the pearling chamber 8. In this case the water flow meter 30 is located in the portion of the water line 28 between the water supply pump 47 and the water inlet 48 of the pearling chamber 8. The water supply pump 47 and tank 29 are connected by another line 49. The motor 44 for the rice-feeding rotary valve 45 and the motor 46 for the water supply pump 47 are connected to an electric controller 50 which proportionally controls the respective voltages, through conductors 51, 52. Thus, when the number of revolution per unit time of the rice-feeding rotary valve 45 is changed and set to a desired value, the rotational speed of the water supply pump 47 is proportionally increased or decreased so that water is supplied at a constant ratio to rice despite any change in the flow rate of the rice.

The motors used in this embodiment use commutator rotors. Also, in FIG. 4, there is shown an accumulator 53 installed between the air pump 47 and the flow meter 30.

Figure 5:
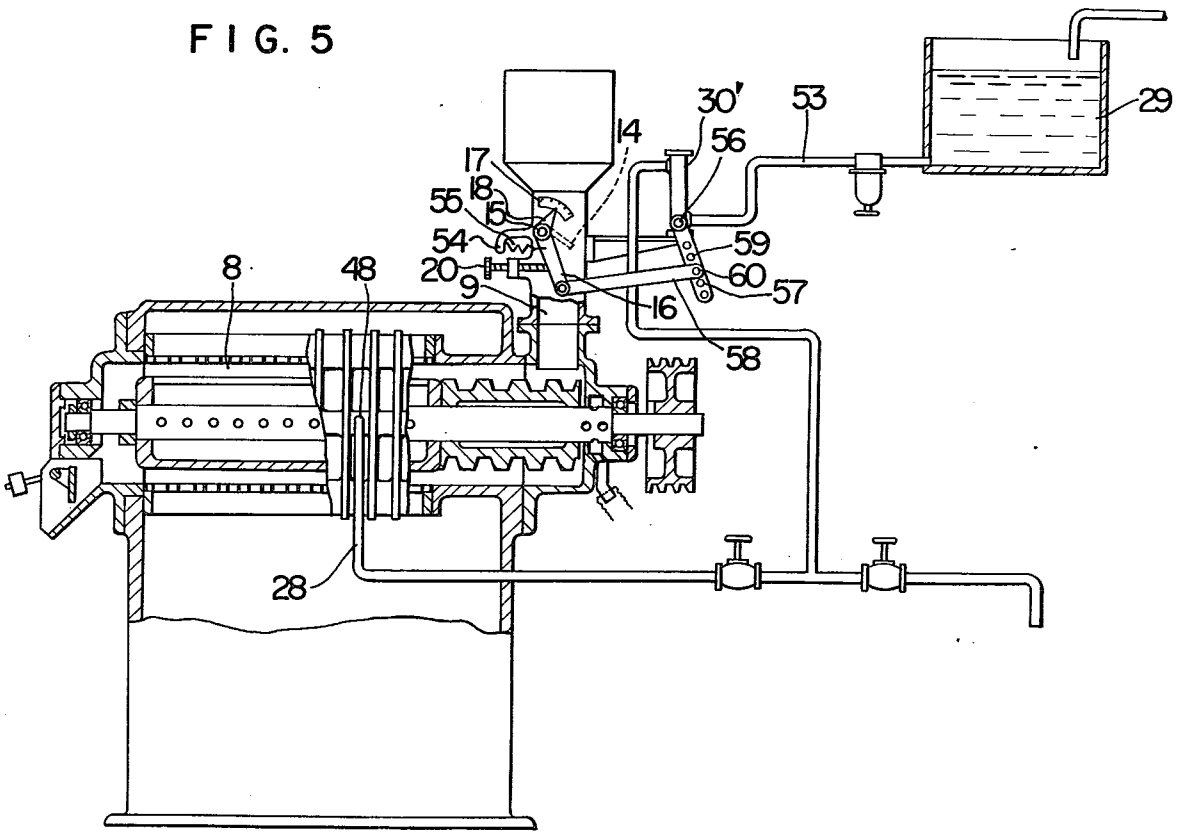
FIG. 5 is a partly sectional side view of still another embodiment of the invention.

FIG. 5 shows still another embodiment of the invention, in which a flow meter 30' with a built-in valve for regulating the flow rate of water is connected at one end to the water supply line 28 leading to the pearling chamber 8 and at the other end to another water supply line 53 leading to the water tank 29. Inside the rice inlet 9 of the pearling apparatus, a rice flow regulating valve 14 is supported by a pivot 15, and one end of the pivot 15 exposed from the outer wall of the rice inlet 9 carries one end of the indicator 18 for the dial 17 and also one end of the lever 16 being urged by a spring 55 toward an arm 54 extended outwardly of the inlet wall. The opposite end of the lever 16 is connected to a lever 57 made fast to the pivot 56 of the flow regulating valve of the flow meter 30' by means of a connecting rod 58. The connecting rod 58 and lever 57 are adjustably connected by a pin 60 which is inserted in a hole at the end of the rod and one of several holes 59 formed in the lever 57 so as to adjust the ratio of the flow rate of rice to that of scouring water. The flow rates of rice and water are generally adjusted by turning the threaded rod 20 clockwise or anticlockwise thereby moving the lever 16 to set the flow rate of rice to a desired value and accordingly adjust the water flow rate.

Various other designs for the mechanism of operatively connecting the flow regulating valves for rice and water are within the contemplation of the invention provided the object of optimumly and precisely adjusting the respective flow rates in coordinated way is achieved.

With reference to the drawings showing a few embodiments thereof, the present invention has been described as applied to the last finishing one of several pearling units arranged in series, and therefore the rice inlet of the last unit is fed with reasonably well-milled rice, milled beforehand to a yield down to about 94%. Alternatively, it is possible to use a large pearling apparatus having a single elongate pearling chamber with the water supply pipe connected to a portion of the chamber where the pearling will proceed to a yield of about 93% or upwards, so that, once brown rice instead of white one is fed to the rice inlet, the single apparatus will carry out all of the pearling operations to deliver fully pearled rice.

The present invention permits a most reasonable scouring and pearling of rice with water through accurate and proper control of the ratio of the amount of rice to be fed to the pearling apparatus to the flow rate of water to be mixed with rice in the finishing stage. The apparatus of the invention thus advantageously accomplishes removal of the aleurone layer and yields bright, finely pearled rice of good quality with a proper moisture content.

What is claimed is:

1. In a rice pearling apparatus including a pearling chamber composed of a pearling roll and a multiple-holed debranning-pearling cylinder surrounding said roll, and means for feeding rice to said pearling chamber, the improvement comprising means for supplying water to said pearling chamber, flow meters for measuring and indicating the rates of rice and water flow into said pearling chamber, means for regulating said respective flow rates, and means for coordinately and automatically adjusting said rates of rice and water flow into said pearling chamber in a suitably predetermined ratio comprising a rotary valve installed in said rice inlet and adapted to be driven by a motor, a water supply pump mounted in said water supply means and driven by another motor, and an electric controller electrically connected to both said motors to control their voltages proportionally.

* * * * *